US011421360B2

(12) United States Patent
Tokuno et al.

(10) Patent No.: US 11,421,360 B2
(45) Date of Patent: Aug. 23, 2022

(54) FIBER SHEET AND METHOD FOR MANUFACTURING SAME

(71) Applicant: Kabushiki Kaisha Toshiba, Minato-ku (JP)

(72) Inventors: Yoko Tokuno, Ota (JP); Ikuo Uematsu, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 181 days.

(21) Appl. No.: 17/012,773

(22) Filed: Sep. 4, 2020

(65) Prior Publication Data

US 2020/0399802 A1 Dec. 24, 2020

Related U.S. Application Data

(60) Division of application No. 15/460,820, filed on Mar. 16, 2017, now Pat. No. 10,801,140, which is a (Continued)

(30) Foreign Application Priority Data

Mar. 16, 2016 (JP) ..... 2016-053090

(51) Int. Cl.
*D04H 1/552* (2012.01)
*D04H 1/728* (2012.01)
(Continued)

(52) U.S. Cl.
CPC ..... *D04H 1/552* (2013.01); *D01D 5/003* (2013.01); *D01D 5/0092* (2013.01); *D01D 10/06* (2013.01); *D04H 1/728* (2013.01); *D04H 1/74* (2013.01)

(58) Field of Classification Search
CPC ..... D04H 1/552; D04H 1/74; D04H 1/728; D01D 5/0092; D01D 10/06; D01D 5/003
See application file for complete search history.

(56) References Cited

U.S. PATENT DOCUMENTS

2010/0233115 A1* 9/2010 Patel ..... D01D 5/0076 425/174.8 E
2010/0273258 A1* 10/2010 Lannutti ..... D01D 5/003 435/366

(Continued)

FOREIGN PATENT DOCUMENTS

CN 102499800 A 6/2012
JP 2005-126865 5/2005

(Continued)

OTHER PUBLICATIONS

International Search Report dated Nov. 29, 2016 in PCT/JP2016/075496, filed on Aug. 31, 2016 ( with English Translation of Categories of Cited Documents).

(Continued)

*Primary Examiner* — Jeremy R Pierce
(74) *Attorney, Agent, or Firm* — Oblon, McClelland, Maier & Neustadt, L.L.P.

(57) ABSTRACT

According to one embodiment, a fiber sheet includes a plurality of fibers. The plurality of fibers are in a closely-adhered state. All of the following (1) to (3) are satisfied, where F1 is a tensile strength in a first direction, and F2 is a tensile strength in a second direction orthogonal to the first direction: (1) F2>F1; (2) F1 is 1 MPa or more; and (3) F2/F1 is 2 or more.

4 Claims, 9 Drawing Sheets

Related U.S. Application Data continuation of application No. PCT/JP2016/075496, filed on Aug. 31, 2016.

(51) Int. Cl.

| | |
|---|---|
| ***D04H 1/74*** | (2006.01) |
| ***D01D 5/00*** | (2006.01) |
| ***D01D 10/06*** | (2006.01) |

(56) References Cited

U.S. PATENT DOCUMENTS

| | | | | |
|---|---|---|---|---|
| 2011/0264235 | A1 | 10/2011 | Chen | |
| 2012/0029654 | A1* | 2/2012 | Xu | D04H 1/728 623/23.72 |
| 2014/0030315 | A1 | 1/2014 | Johnson | |

FOREIGN PATENT DOCUMENTS

| | | | |
|---|---|---|---|
| JP | 2008-303514 | | 12/2008 |
| JP | 2009-233550 | | 10/2009 |
| JP | 2012-527217 | | 11/2012 |
| JP | 2013-139655 | A | 7/2013 |
| JP | 2014-101320 | | 6/2014 |
| JP | 2014-101613 | A | 6/2014 |
| KR | 10-2011-0129111 | A | 12/2011 |
| WO | WO 01/80921 | A2 | 11/2001 |
| WO | WO 2017/171341 | A2 | 10/2017 |

OTHER PUBLICATIONS

Written Opinion dated Nov. 29, 2016 in PCT/JP2016/075496, filed on Aug. 31, 2016.

Geun Hyung Kim, "Electrospun PCL Nanofibers with Anisotropic Mechanical Properties as a Biomedical Scaffold" Biomedical Materials, vol. 3, No. 2, XP020140073, Jun. 1, 2008, 25010 pp. 1-8.

Wei et al., "Modeling of Mechanical Properties of Electrospun Nanofiber Network", Int. J. Experimental and Computational Biomechanics, vol. 1, No. 1, pp. 45-57, 2009.

* cited by examiner

FIBER SHEET AND METHOD FOR MANUFACTURING SAME

CROSS-REFERENCE TO RELATED APPLICATIONS

This application is a divisional of U.S. application Ser. No. 15/460,820 filed Mar. 16, 2017, now issued as U.S. Pat. No. 10,801,140, and which is based upon and claims the benefit of priority from the Japanese Patent Application No. 2016-053090, filed Mar. 16, 2016, and the PCT Patent Application PCT/JP2016/075496, filed on Aug. 31, 2016; the entire contents of each of which are incorporated herein by reference.

FIELD

Embodiments of the invention relate to a fiber-oriented sheet and a method for manufacturing the fiber sheet.

BACKGROUND

There is a deposited body made by forming a fine fiber using electrospinning (also called electric field spinning, charge-induced spinning, etc.) and by depositing the fiber that is formed.

In such a case, the tensile strength of the fiber formed using electrospinning is low; therefore, the tensile strength of the deposited body also is low.

Also, anisotropy of the tensile strength of the deposited body cannot be high because the deposited body is made by randomly depositing the fibers.

Therefore, it is desirable to develop a sheet having high tensile strength and high anisotropy of the tensile strength.

DETAILED DESCRIPTION

According to one embodiment, a fiber sheet includes a plurality of fibers. The plurality of fibers are in a closely-adhered state.

All of the following (1) to (3) are satisfied, where F1 is a tensile strength in a first direction, and F2 is a tensile strength in a second direction orthogonal to the first direction:

(1) F2>F1;

(2) F1 is 1 MPa or more; and (3) F2/F1 is 2 or more.

Embodiments will now be described.

(Fiber Sheet)

The fiber sheet according to the embodiment includes a plurality of fibers.

For example, the fiber can be formed using electrospinning.

The fiber includes a polymeric substance. For example, the polymeric substance can be an industrial material such as polypropylene, polyethylene, polystyrene, polyethylene terephthalate, polyvinyl chloride, polycarbonate, nylon, aramid, polyacrylate, polymethacrylate, polyimide, polyamide-imide, polyvinylidene fluoride, polyethersulfone, etc., a bio-affinity material such as collagen, laminin, gelatin, polyacrylonitrile, chitin, polyglycolic acid, polylactic acid, etc. However, the polymeric substance is not limited to those illustrated.

Also, the fibers are closely adhered. According to the solvent used in a "close-adhesion process" described below, one portion of the fibers may be melted; and the fibers may be fused in the melted portion.

Therefore, in the specification, the state in which the fibers are closely adhered, and the state in which the fibers are closely adhered and a portion is further fused are called the "closely-adhered state."

Figure 6A:
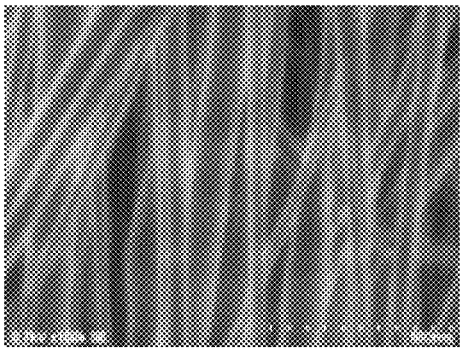
FIG. 6A is an electron micrograph of the deposited body.
Figure 6B:
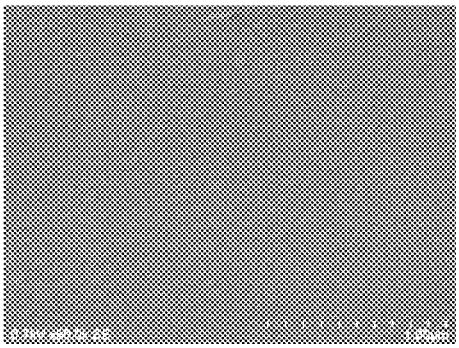
FIG. 6B is an electron micrograph of the fiber sheets.

In the fiber sheet, it is difficult to measure the diametrical dimension of the fibers because the fibers included in the fiber sheet are in the closely-adhered state (referring to FIG. 6B).

However, it can be proved that the fibers exist in the closely-adhered state from the anisotropy of the tensile strength described below, from the direction described below in which the long axes of the molecules extend, etc.

Also, because the fibers are caused not to dissolve as much as possible in the close-adhesion process described below, the diametrical dimension of the fibers included in the fiber sheet can be taken to be the diametrical dimension of the fibers included in the deposited body.

In such a case, the average diameter of the fibers included in the deposited body can be set to be not less than 0.05 μm and not more than 5 μm.

For example, the average diameter of the fibers included in the deposited body can be determined by imaging an electron micrograph of the surface of a deposited body 7 described below (referring to FIG. 6A) and by averaging the diametrical dimensions of any 100 fibers confirmed using the electron micrograph.

Also, in the fiber sheet, the pores that are included in the fiber sheet are small because the fibers that are included are in the closely-adhered state. The maximum dimension of the pores included in the fiber sheet is, for example, less than 0.5 μm. For example, the maximum dimension of the pores can be determined by imaging an electron micrograph of the surface of the fiber sheet and by measuring the dimensions of the pores confirmed using the electron micrograph.

If the fibers that are included are in the closely-adhered state, the tensile strength of the fiber sheet can be higher.

The tensile strength can be measured using a constant-rate-of-extension type tensile testing machine, etc.

In such a case, for example, the tensile strength can be measured in conformance with JIS P8113.

Also, in the fiber sheet, the directions in which the fibers extend are substantially aligned. In other words, in the fiber sheet, the fibers extend in about the same direction. In the specification, the fibers are called "oriented" when the fibers extend in about the same direction.

If the fibers are "oriented," the tensile strength of the fiber sheet in the direction in which the fibers extend is higher. On the other hand, the tensile strength of the fiber sheet in a direction orthogonal to the direction in which the fibers extend is lower. Therefore, the tensile strength of the fiber sheet can be provided with anisotropy. However, because the tensile strength of the fiber sheet is low in the direction orthogonal to the direction in which the fibers extend, the mechanical strength of the sheet is insufficient; and there are cases where the transferring inside apparatuses and/or operations in culture experiments and surgical treatment become difficult. If the fibers that are included are in the closely-adhered state, the tensile strength of the fiber sheet can be higher in the direction orthogonal to the direction in which the fibers extend.

In the fiber sheet according to the embodiment, F1 is 1 MPa or more, and F2/F1 is 2 or more, where F1 is the tensile strength of the fiber sheet in one direction (corresponding to an example of a first direction), and F2 is the tensile strength of the fiber sheet in a direction (corresponding to an example of a second direction) orthogonal to this direction. However, F2>F1.

Here, the deposited body that is made by randomly depositing the fibers has low tensile strength and low anisotropy of the tensile strength of the deposited body (the isotropy of the tensile strength of the deposited body is high).

In such a case, although F2/F1 described above is about 6 to 10, F1 is less than 1 MPa; and the deposited body is easy to tear.

Therefore, it can be known whether or not the fibers are oriented by determining F2/F1.

Also, according to designated technical fields, applications, etc., there are also cases where it is important for the degree of the orientation of the fibers to be high (F2/F1 being large).

The fiber sheet according to the embodiment has a high degree of the orientation of the fibers and therefore is applicable also to designated technical fields, applications, etc.

As an example, high tensile strength and/or degree of molecular orientation can be provided in the orientation direction of the fibers. Also, high elongation characteristics can be provided in the direction orthogonal to the orientation of the fibers.

Also, in an elongated polymeric substance, there is a tendency for the direction in which the long axes of the molecules extend (the molecular axis) to be in the direction in which the polymeric substance (the fibers) extends. Therefore, the direction in which the fibers extend and even whether or not the fibers are oriented can be known by verifying the direction in which the long axes of the molecules extend at the surface of the fiber sheet.

The direction in which the long axes of the molecules extend can be known using a structure determination method corresponding to the type of the polymeric substance.

For example, Raman spectroscopy can be used in the case of polystyrene, etc.; and polarized absorption spectroscopy can be used in the case of polyimide, etc.

Here, the case is described as an example where the polymeric substance is an organic compound including an amide group such as collagen, etc. In the case of an organic compound including an amide group, for example, the direction in which the long axes of the molecules extend and even whether or not the fibers are oriented can be known using a polarized FT-IR-ATR method which is one type of infrared spectroscopy.

In such a case, as recited below, the direction in which the long axes of the molecules extend can be determined by analyzing the surface of the fiber sheet using a polarized FT-IR-ATR method.

T1 is the absorption intensity for a wave number of 1640 $cm^{-1}$; and T2 is the absorption intensity for a wave number of 1540 $cm^{-1}$.

In such a case, the absorption intensity T1 is the absorption intensity in the direction orthogonal to the direction in which the long axes of the molecules extend. The absorption intensity T2 is the absorption intensity in the direction in which the long axes of the molecules extend.

Therefore, it can be seen that there are many molecules extending in a first polarization direction if a first absorbance ratio R1 (T1/T2) in the polarization direction is not small.

Also, the absorbance ratio R1 in the prescribed polarization direction and a second absorbance ratio R2 when the orientation of the fiber sheet is changed (e.g., when the orientation of the fiber sheet has been rotated 90°) can be determined; and R1/R2 can be used as an orientation degree parameter. However, R1>R2.

R1/R2 is large in the fiber sheet according to the embodiment. For example, as described below, R1/R2 is 1.1 or more.

A large R1/R2 means that the directions in which the long axes of the molecules extend are aligned.

Also, as described above, in an elongated polymeric substance, there is a tendency for the direction in which the long axes of the molecules extend to be the direction in which the fibers extend. Therefore, a large R1/R2 means that the fibers are oriented (the directions in which the fibers extend are aligned).

Also, according to designated technical fields, applications, etc., there are also cases where it is important for the directions in which the long axes of the molecules extend in the polymeric substance included in the fibers to be aligned (R1/R2 being large).

The fiber sheet according to the embodiment is applicable also to designated technical fields, applications, etc., because the directions in which the long axes of the molecules extend in the polymeric substance included in the fibers are aligned (R1/R2 is large).

(Method for Manufacturing the Fiber Sheet)

A method for manufacturing the fiber sheet according to the embodiment will now be described.

First, fine fibers are formed using an electrospinning apparatus 1; and the fibers that are formed are deposited to form a deposited body. Also, when depositing the fibers that are formed, the directions in which the fibers extend in the deposited body are aligned as much as possible by mechanically pulling the fibers in one direction.

Figure 1:
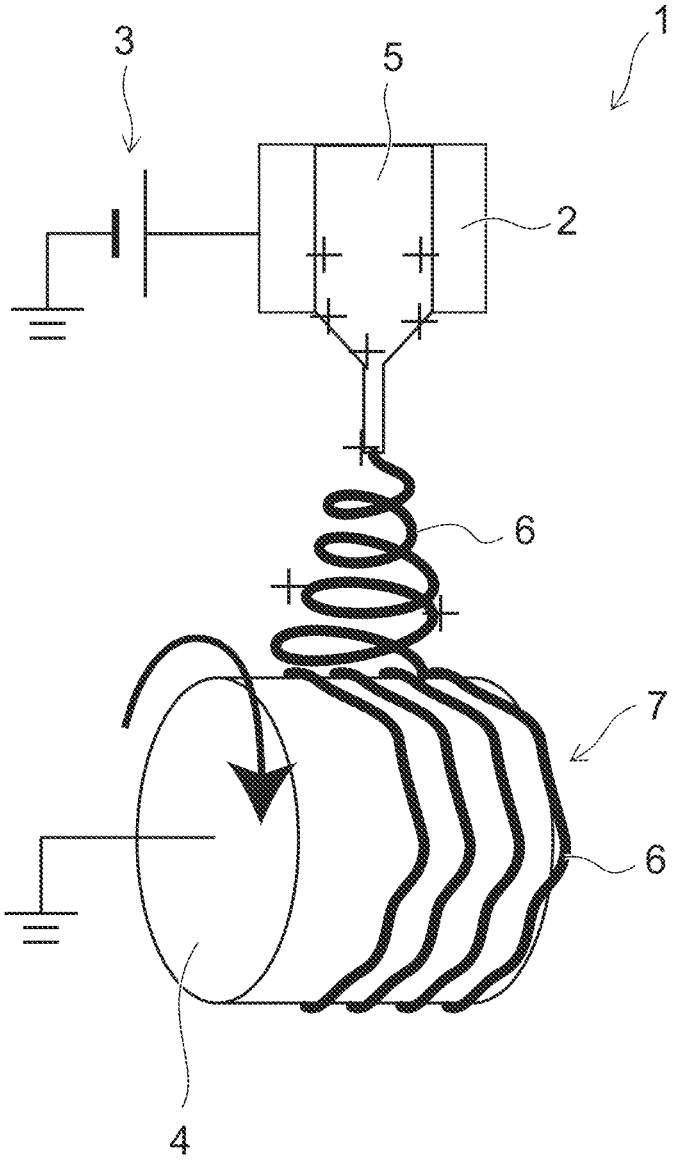
FIG. 1 is a schematic view for illustrating the electrospinning apparatus according to a first embodiment.

FIG. 1 is a schematic view for illustrating the electrospinning apparatus 1.

As shown in FIG. 1, a nozzle 2, a power supply 3, and a collector 4 are provided in the electrospinning apparatus 1.

A hole for discharging a source material liquid (hereafter, first liquid) 5 is provided in the interior of the nozzle 2.

The power supply 3 applies a voltage of a prescribed polarity to the nozzle 2. For example, the power supply 3 applies a voltage to the nozzle 2 so that the potential difference between the nozzle 2 and the collector 4 is 10 kV or more. The polarity of the voltage applied to the nozzle 2 can be positive or can be negative. The power supply 3 illustrated in FIG. 1 applies a positive voltage to the nozzle 2.

The collector 4 is provided on the side of the nozzle 2 where the first liquid 5 is discharged. The collector 4 is grounded. A voltage that has the reverse polarity of the voltage applied to the nozzle 2 may be applied to the collector 4. Also, the collector 4 has a circular columnar configuration and rotates.

The first liquid 5 includes a polymeric substance dissolved in a solvent.

The polymeric substance is not particularly limited and can be modified appropriately according to the material properties of the fiber 6 to be formed. The polymeric substance can be, for example, an industrial material such as polypropylene, polyethylene, polystyrene, polyethylene terephthalate, polyvinyl chloride, polycarbonate, nylon, aramid, etc., a bio-affinity material such as collagen, laminin, gelatin, polyacrylonitrile, chitin, polyglycolic acid, etc.

It is sufficient for the solvent to be able to dissolve the polymeric substance. The solvent can be modified appropriately according to the polymeric substance to be dissolved. The solvent can be, for example, water, an alcohol (methanol, ethanol, isopropyl alcohol, trifluoroethanol, hexafluoro-2-propanol, etc.), acetone, benzene, toluene, cyclohexanone, N,N-dimethylacetamide, N,N-dimethylformamide, N-methyl-2-pyrrolidone, dimethylsulfoxide, etc.

Also, an additive such as an inorganic electrolyte, an organic electrolyte, a surfactant, a defoamer, etc., may be used.

The polymeric substance and the solvent are not limited to those illustrated.

The first liquid 5 collects at the vicinity of the outlet of the nozzle 2 due to surface tension.

The power supply 3 applies a voltage to the nozzle 2.

Then, the first liquid 5 at the vicinity of the outlet is charged with a prescribed polarity. In the case illustrated in FIG. 1, the first liquid 5 that is at the vicinity of the outlet is charged to be positive.

Because the collector 4 is grounded, an electric field is generated between the nozzle 2 and the collector 4. Then, when the electrostatic force that acts along the lines of electric force becomes larger than the surface tension, the first liquid 5 at the vicinity of the outlet is drawn out toward the collector 4 by the electrostatic force. The first liquid that is drawn out is elongated; and the fiber 6 is formed by the volatilization of the solvent included in the first liquid. The fiber 6 that is formed is deposited on the rotating collector 4 to form the deposited body 7. Also, the fiber 6 is pulled in the rotation direction when the fiber 6 is deposited on the rotating collector 4.

In other words, when the fiber 6 that is formed is deposited, the directions in which the fibers extend in the deposited body 7 are aligned by mechanically pulling the fiber 6 in one direction.

The method for mechanically pulling the fiber 6 in one direction is not limited to the illustration. For example, a gas can be caused to flow in the direction in which the fiber 6 is drawn out; and the fiber 6 can be mechanically pulled in the one direction also by the gas flow.

Figure 2A:
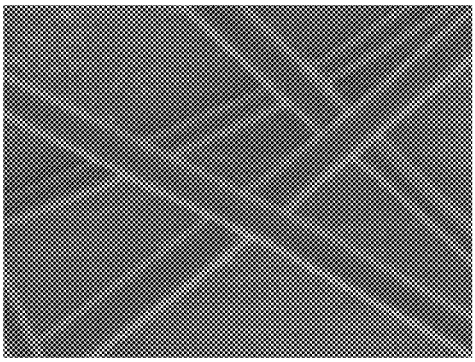
FIG. 2A is an electron micrograph of the case where the fiber is deposited on a stationary collector having a flat plate configuration.

FIG. 2A is an electron micrograph of the case where the fiber 6 is deposited on a stationary collector having a flat plate configuration.

Figure 2B:
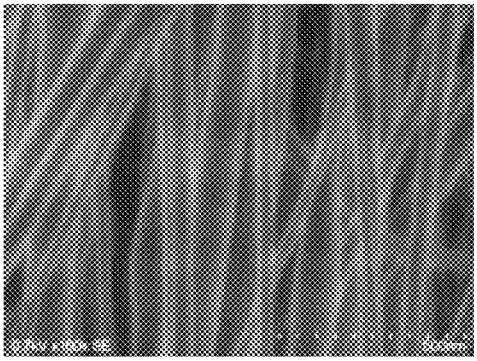
FIG. 2B is an electron micrograph of the case where the fiber is deposited on the rotating collector.

FIG. 2B is an electron micrograph of the case where the fiber 6 is deposited on the rotating collector 4.

It can be seen from FIGS. 2A and 2B that if the fiber 6 that is formed is pulled mechanically in one direction when depositing the fiber 6, the directions in which the fibers 6 extend in the deposited body 7 can be somewhat aligned. Also, the space (the pores) between the fibers 6 can be reduced.

However, a disturbance due to wind and/or electric fields occurs when mechanically pulling the fiber 6 in the one direction by the gas flow and/or the rotating collector 4. Therefore, the alignment of the directions in which the fibers 6 extend is limited when pulling the fiber 6 only mechanically in the one direction.

Therefore, in the method for manufacturing the fiber sheet according to the embodiment, the directions in which the fibers 6 extend are aligned further by performing the close-adhesion process recited below.

First, a volatile liquid is supplied to the deposited body 7.

For example, the deposited body 7 is immersed in the volatile liquid.

Although the volatile liquid is not particularly limited, it is favorable for the volatile liquid not to dissolve the fiber 6 as much as possible. The volatile liquid can be, for example, an alcohol (methanol, ethanol, isopropyl alcohol, etc.), an alcohol aqueous solution, acetone, acetonitrile, ethylene glycol, etc.

Then, the drying process recited below is performed.

Figure 3A:
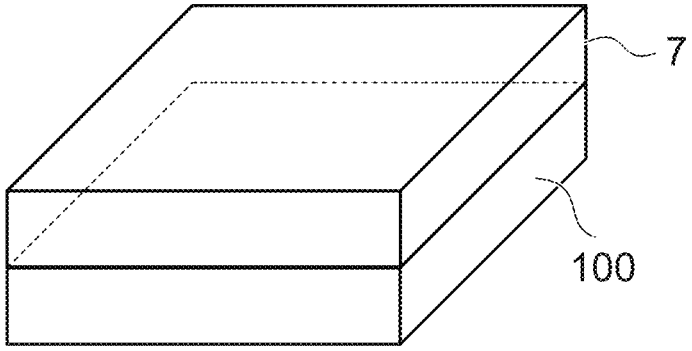
FIGS. 3A and 3B are schematic perspective views for illustrating the state prior to the drying.
Figure 3B:
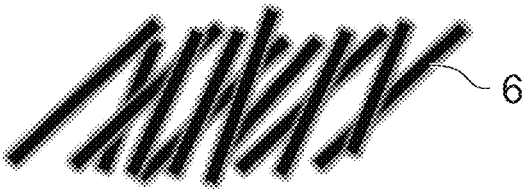

FIGS. 3A and 3B are schematic perspective views for illustrating the state prior to the drying.

First, as shown in FIG. 3A, the deposited body 7 that includes the volatile liquid is placed on a base 100.

Prior to the drying, the directions in which the fibers 6 extend are somewhat aligned as shown in FIG. 3B.

Continuing, the deposited body 7 that includes the volatile liquid is dried.

Figure 4A:
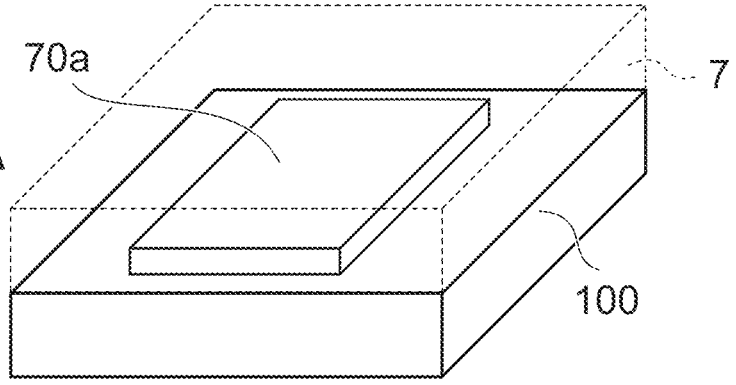
FIGS. 4A and 4B are schematic perspective views for illustrating the case where the drying is performed in a state in which slippage occurs between the deposited body and the base.
Figure 4B:
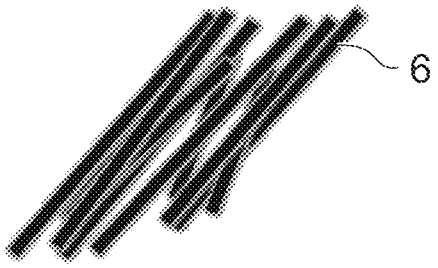

FIGS. 4A and 4B are schematic perspective views for illustrating the case where the drying is performed in a state in which slippage occurs between the deposited body 7 and the base 100.

Figure 5A:
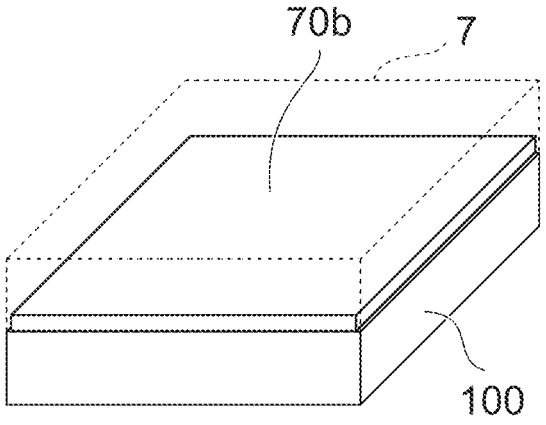
FIGS. 5A and 5B are schematic perspective views for illustrating the case where the drying is performed in a state in which the slippage between the deposited body and the base does not occur easily.
Figure 5B:
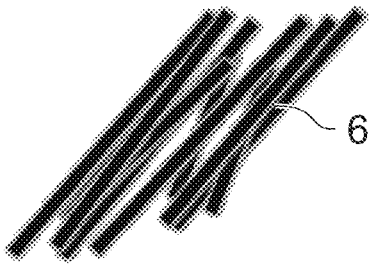

FIGS. 5A and 5B are schematic perspective views for illustrating the case where the drying is performed in a state in which the slippage between the deposited body 7 and the base 100 does not occur easily.

The slippage between the deposited body 7 and the base 100 can be controlled using the material of the fiber 6 and the material of the base 100. For example, in the case where the material of the fiber 6 is collagen, the slippage between the deposited body 7 and the base 100 can be suppressed by using polystyrene as the material of the base 100.

The drying method is not particularly limited. For example, the deposited body 7 that includes the volatile liquid may be dried in ambient air (natural drying), may be dried by heating (heated drying), or may be dried in a reduced-pressure environment (reduced-pressure drying).

In the case where the drying is performed in the state in which the slippage occurs between the deposited body 7 and the base 100, the volume of the deposited body 7 contracts as an entirety as shown in FIG. 4A; and a fiber sheet 70*a* is formed.

In the case where the drying is performed in the state in which the slippage does not occur easily between the deposited body 7 and the base 100, mainly the thickness dimension of the deposited body 7 contracts as shown in FIG. 5A; and a fiber sheet 70*b* is formed.

Here, a capillary force acts in the volatile liquid between the fiber 6 and the fiber 6. In other words, the force is applied in directions causing the fiber 6 and the fiber 6 to closely adhere. Therefore, as the drying progresses (as the volatile liquid is removed), the distance between the fiber 6 and the fiber 6 is reduced; and the state of the fiber 6 and the fiber 6 becomes a closely-adhered state as shown in FIG. 4B and FIG. 5B.

Thus, the fiber sheets 70*a* and 70*b* according to the embodiment can be manufactured.

FIG. 6A is an electron micrograph of the deposited body 7. Namely, FIG. 6A illustrates the state of the fibers 6 prior to the volatile liquid being supplied.

FIG. 6B is an electron micrograph of the fiber sheets 70*a* and 70*b*. Namely, FIG. 6B illustrates the state of the fibers 6 after the volatile liquid is removed (dried).

It can be seen from FIGS. 6A and 6B that the state of the fiber 6 and the fiber 6 becomes a closely-adhered state if the close-adhesion process described above is performed. In this case, it can be seen from FIG. 6B that the fibers 6 are in a closely adhered state so much that the fibers 6 cannot be confirmed in the electron micrograph.

The directions in which the fibers 6 extend can be aligned further by the fibers 6 being in the closely-adhered state.

In other words, in the fiber sheets 70*a* and 70*b*, the fibers 6 are oriented.

In the fiber sheets 70*a* and 70*b*, the fibers 6 being in the closely-adhered state and the fibers 6 being oriented can be confirmed using the anisotropy of the tensile strength, the direction in which the long axes of the molecules extend, etc., described above.

Further, the direction of the orientation originating in the fibers 6 can be confirmed using an optical microscope.

Figure 7A:
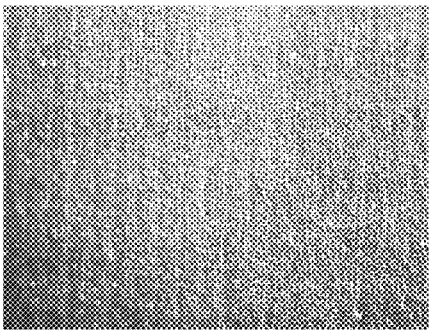
FIGS. 7A and 7B are photomicrographs of the fiber sheets.
Figure 7B:
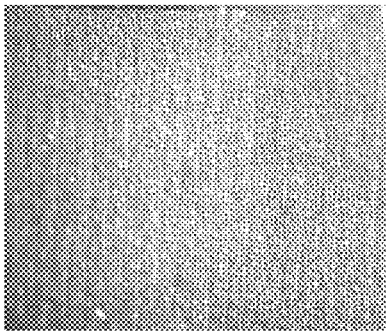

FIGS. 7A and 7B are photomicrographs of the fiber sheets 70*a* and 70*b*.

It can be seen from FIGS. 7A and 7B that a stripe structure having a pitch dimension of about 100 μm could be confirmed by observing the surfaces of the fiber sheets 70*a* and 70*b* using the optical microscope.

It is considered that such a stripe structure is formed because bundles of multiple fibers 6 become collections and contract at a constant spacing as the volatile liquid is removed and the fiber 6 and the fiber 6 become closely adhered.

EXAMPLES

Fiber sheets based on examples will now be described in further detail. However, the invention is not limited to the following examples.

First, the deposited body 7 was formed as follows.

The polymeric substance was collagen which is a bio-affinity material.

The solvent was a mixed solvent of trifluoroethanol and purified water.

The first liquid 5 was a mixed liquid of 2 wt % to 10 wt % of collagen, 80 wt % to 97 wt % of trifluoroethanol, and 1 wt % to 15 wt % of purified water.

The electrospinning apparatus 1 included the rotating collector 4 illustrated in FIG. 1.

The fibers 6 that were formed by the electrospinning apparatus 1 included 10 wt % of collagen or more.

Also, the diameter of the fiber 6 was about 70 nm to 180 nm.

Also, the directions in which the fibers 6 extend in the deposited body 7 were somewhat aligned by mechanically pulling the fibers 6 in one direction using the rotating collector 4. In this case, the state of the fibers 6 in the deposited body 7 was as shown in FIG. 2B described above.

Figure 8:
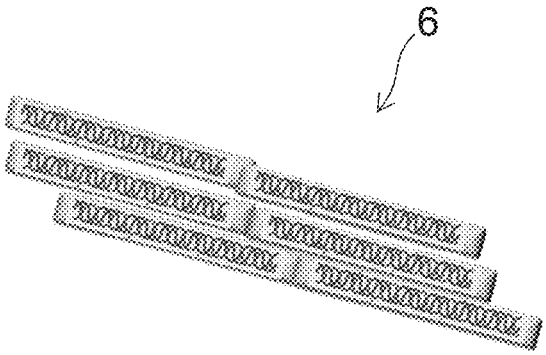
FIG. 8 is a schematic view for illustrating the orientation of the collagen molecules of the fibers formed by the electrospinning apparatus.

FIG. 8 is a schematic view for illustrating the orientation of the collagen molecules of the fibers 6 formed by the electrospinning apparatus 1.

FIGS. 9A to 9D are atomic force micrographs of the surface of the fibers 6.

Figure 9A:
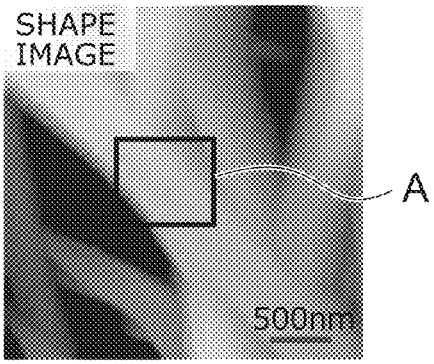
FIGS. 9A to 9D are atomic force micrographs of the surface of the fibers.
Figure 9B:
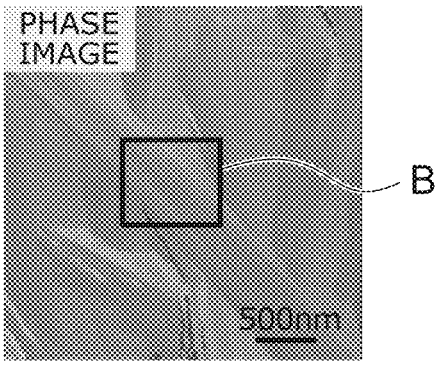

FIG. 9A is a shape image. FIG. 9B is a phase image.

Figure 9C:
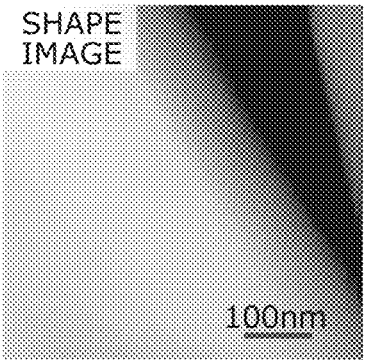
Figure 9D:
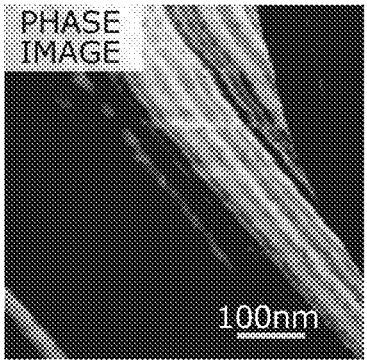

FIG. 9C is an enlarged photograph of portion A in FIG. 9A. FIG. 9D is an enlarged photograph of portion B in FIG. 9B.

By acquiring the phase image using the atomic force microscope, the elastic modulus change of the surface of the fibers 6 can be analyzed. In other words, by the phase image, contrast having line configurations originating in the hardness (elastic modulus) difference in the surface of the fibers 6 can be confirmed.

It can be seen from FIGS. 9A to 9D that contrast having line configurations originating in the hardness difference in the axis direction of the fibers 6 can be confirmed by analyzing the surface of the fibers 6 formed by the electrospinning apparatus 1 using an atomic force microscope.

It is considered that a high degree of molecular orientation can be obtained by orienting the fibers 6 having such a configuration.

Then, the deposited body 7 was immersed in ethanol. The concentration of the ethanol was 40 wt % to substantially 100 wt %. Also, the immersion in the ethanol was performed in ambient air. The temperature of the ethanol was room temperature. The immersion time was not particularly limited; and the deposited body 7 was withdrawn from the ethanol at the point in time when the ethanol had filled sufficiently into the deposited body 7.

Then, the deposited body 7 that included the ethanol was dried.

The drying was performed in ambient air; and the drying temperature was room temperature. In other words, natural drying of the deposited body 7 including ethanol was performed.

In such a case, the fiber sheet 70*a* was made by drying in a state in which slippage occurs between the deposited body 7 and the base 100. Also, the fiber sheet 70*b* was made by drying in a state in which the slippage does not occur easily between the deposited body 7 and the base 100. The base 100 that was formed using polystyrene was used in the case of drying in the state in which the slippage does not occur easily between the deposited body 7 and the base 100.

Thus, the fiber sheets 70*a* and 70*b* that include collagen were manufactured. In this case, the states of the fibers 6 of the fiber sheets were as shown in FIG. 6B and FIGS. 7A and 7B described above.

It can be seen from FIG. 6B and FIGS. 7A and 7B that pores included in the fiber sheets 70*a* and 70*b* were not confirmed.

Figure 10:
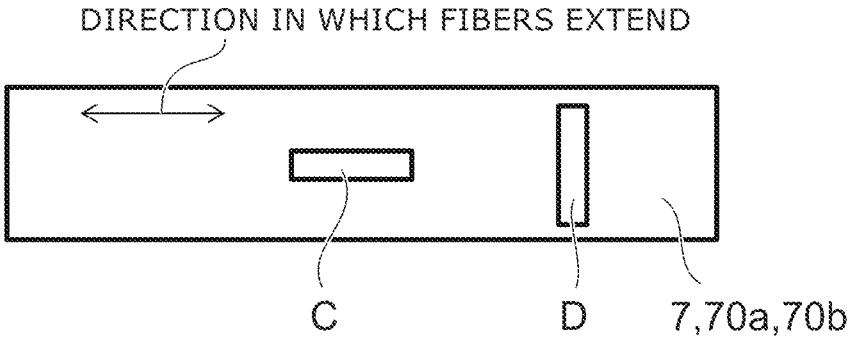
FIG. 10 is a schematic view for illustrating test pieces C and D used in a tensile test.

FIG. 10 is a schematic view for illustrating test pieces C and D used in a tensile test.

As shown in FIG. 10, the test piece C is a test piece in which the longitudinal direction of the test piece is parallel to the direction in which the fibers 6 extend; and the test piece D is a test piece in which the longitudinal direction of the test piece is perpendicular to the direction in which the fibers 6 extend.

Figure 11A:
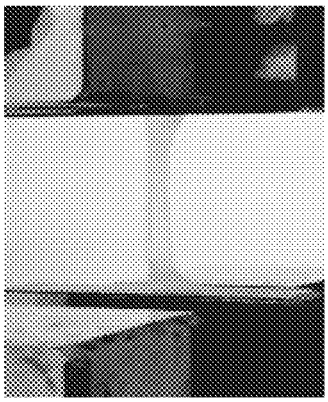
FIGS. 11A and 11B are photographs for illustrating the states of the tensile tests.
Figure 11B:
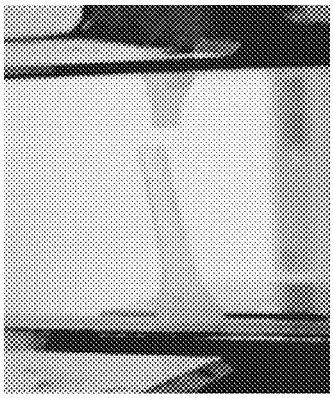

FIGS. 11A and 11B are photographs for illustrating the states of the tensile tests.

FIG. 11A is a photograph for illustrating the state at the start of the tensile test. FIG. 11B is a photograph for illustrating the state at the fracture of the test piece.

Figure 12A:
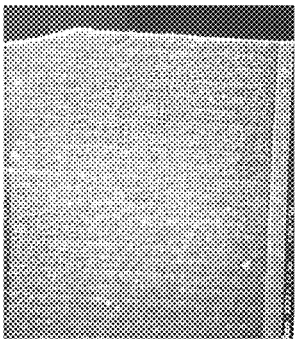
FIG. 12A is a photomicrograph of the test piece D.

FIG. 12A is a photomicrograph of the test piece D.

Figure 12B:
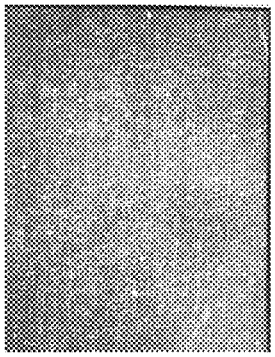
FIG. 12B is a photomicrograph of the test piece C.

FIG. 12B is a photomicrograph of the test piece C.

Figure 13:
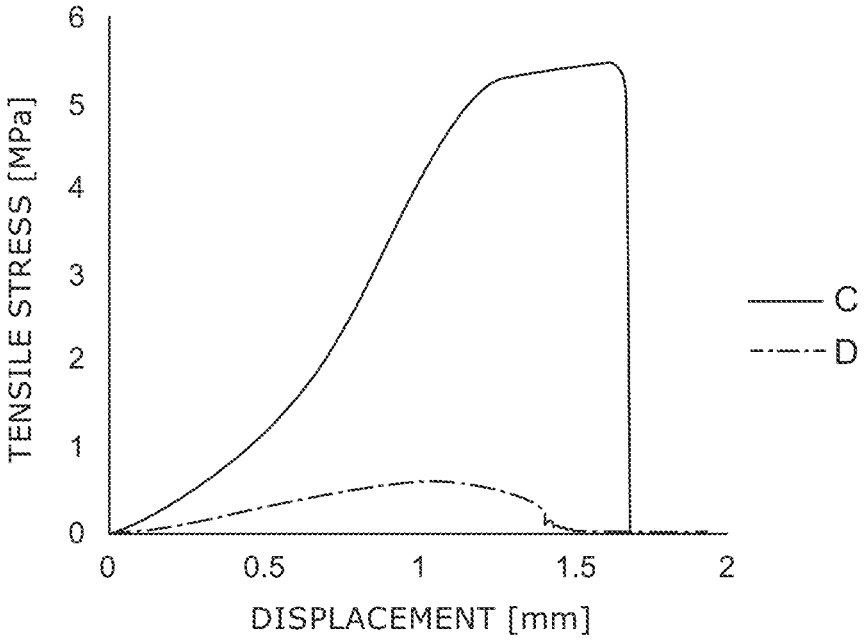
FIG. 13 is a graph for illustrating the results of the tensile test of the deposited body.

FIG. 13 is a graph for illustrating the results of the tensile test of the deposited body 7.

For the test pieces C and D including collagen, the thickness dimension was about 90 μm; the width dimension was 2 mm; and the length dimension was 12 mm. Also, the elongation speed was 1 mm/min.

It can be seen from FIG. 13 that the tensile strength of the test piece C divided by the tensile strength of the test piece D was 5.6; and the tensile elongation rate was 9% to 11%.

The tensile strength is taken to be the maximum stress per cross-sectional area.

Figure 14:
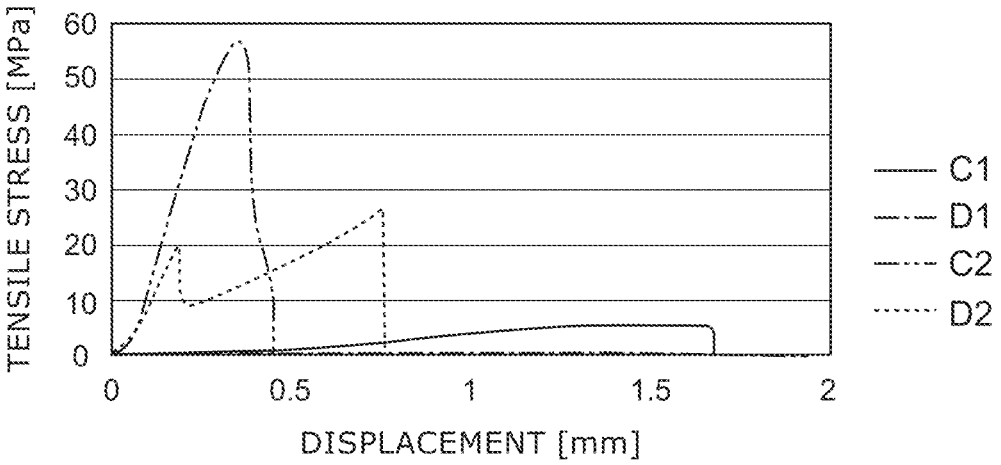
FIG. 14 is a graph for comparing the result of the tensile test of the deposited body and the result of the tensile test of the fiber sheets.

FIG. 14 is a graph for comparing the result of the tensile test of the deposited body 7 and the result of the tensile test of the fiber sheets 70*a* and 70*b*.

The test pieces C1 and D1 are test pieces formed from the deposited body 7; and the test pieces C2 and D2 are test pieces formed from the fiber sheets 70*a* and 70*b* (the deposited body 7 for which the close-adhesion process described above was performed).

For the test pieces C1, C2, D1, and D2 including collagen, the thickness dimension was about 30 μm; the width dimension was 2 mm; and the length dimension was 12 mm. Also, the elongation speed was 1 mm/min.

Here, a hard surface where the fibers 6 are closely adhered more finely due to the ethanol treatment is formed on the side of the base 100 of the fiber sheets 70*a* and 70*b*.

Therefore, it is considered that a peak of the tensile stress such as that shown in FIG. 14 occurred because the hard surface fractured in the initial part of the tensile test for the test piece D1.

F1 was 28 MPa, and F2/F1 was 3.2, where F1 is the tensile strength of the fiber sheets 70*a* and 70*b* in one direction, and F2 is the tensile strength of the fiber sheets 70*a* and 70*b* in a direction orthogonal to this direction. However, F2>F1.

Therefore, it was proved that the fiber sheets 70*a* and 70*b* have high tensile strength and high anisotropy of the tensile strength. Also, it was proved that the fibers 6 are oriented (the directions in which the fibers 6 extend are aligned) in the fiber sheets 70*a* and 70*b*.

Also, the direction in which the long axes of the molecules extend was determined by analyzing the surfaces of the fiber sheets 70*a* and 70*b* by a polarized FT-IR-ATR method.

The absorption intensity T1 for a wave number of 1640 $cm^{-1}$ was 0.075; and the absorption intensity T2 for a wave number of 1540 $cm^{-1}$ was 0.043.

The absorbance ratio R1 (T1/T2) in the first polarization direction was 1.748; and the absorbance ratio R2 when the orientations of the fiber sheets 70*a* and 70*b* had been rotated 90° was 1.575.

Therefore, the orientation degree parameter (R1/R2) of the fiber sheets 70*a* and 70*b* was 1.13.

The orientation degree parameter (R1/R2) was 1.04 when similarly analyzing the surface of the deposited body 7 prior to immersing in ethanol.

Therefore, it was proved that for the fiber sheets 70*a* and 70*b*, the directions in which the long axes of the molecules extend are aligned because the orientation degree parameter (R1/R2) is large. Also, it was proved that for the fiber sheets 70*a* and 70*b*, the fibers 6 are oriented (the directions in which the fibers 6 extend are aligned).

TABLE 1

| | | | | FINAL | | ORIENTATION | TENSILE STRENGTH | | TENSILE |
|---|---|---|---|---|---|---|---|---|---|
| | MATERIAL | THICKNESS μm | VOLATILE SOLVENT | THICKNESS μm | FIBER ADHESION | DEGREE PARAMETER — | PARALLEL [MPa] | PERPENDICULAR [MPa] | STRENGTH RATIO — |
| FIRST EXAMPLE 1 | COLLAGEN | 25 | ETHANOL | 5 | HIGH | 1.13 | — | — | — |
| FIRST EXAMPLE 2 | COLLAGEN | 100 | ETHANOL | 20 | HIGH | — | 87.9 | 27.9 | 3.15 |
| FIRST EXAMPLE 3 | COLLAGEN | 100 | WATER/ ETHANOL = 40/60 | 20 | HIGH | 1.10 | — | — | — |
| FIRST EXAMPLE 4 | COLLAGEN | 100 | WATER/ ETHANOL = 60/40 | 20 | HIGH | 1.10 | — | — | — |
| FIRST EXAMPLE 5 | COLLAGEN | 150 | ETHANOL | 30 | HIGH | — | 59.4 | 26.7 | 2.22 |
| FIRST EXAMPLE 6 | POLYIMIDE | 110 | ETHANOL | 90 | LOW | — | 6.69 | 1.03 | 6.50 |
| FIRST COMPARATIVE EXAMPLE 1 | COLLAGEN | 25 | — | 25 | LOW | 1.03 | — | — | — |
| FIRST COMPARATIVE EXAMPLE 2 | COLLAGEN | 100 | — | 100 | LOW | 1.03 | 3.07 | 0.54 | 5.69 |
| FIRST COMPARATIVE EXAMPLE 3 | COLLAGEN | 150 | — | 150 | LOW | — | 5.48 | 0.8 | 9.13 |

Table 1 is a table for illustrating the effects of the "close-adhesion process."

It can be seen from Table 1 that the invention is applicable not only to bio-affinity materials such as collagen, etc., but also to industrial materials such as polyimide, etc.

In other words, by performing the "close-adhesion process" described above, the improvement of the degree of molecular orientation, the increase of the tensile strength, the maintaining of the anisotropy of the tensile strength, etc., can be realized even for a fiber sheet made of an industrial material.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A fiber sheet formed of deposited fibers, comprising:

fibers including a bio-affinity material and an amid group;

an orientation degree parameter expressed by the following formulas being 1.1 or more when a surface of the fiber sheet is analyzed using a polarized FT-IR-ATR method:

the orientation degree parameter is R1/R2;

R1 is a first absorbance ratio in a first polarization direction;

R2 is a second absorbance ratio when an orientation of the fiber sheet has been rotated 90°;

R1>R2; and the absorbance ratio is T1/T2, wherein T1 is an absorption intensity for a wave number of 1640 $cm^{-1}$, and T2 is an absorption intensity for a wave number of 1540 $cm^{-1}$.

2. The fiber sheet according to claim 1, wherein the fibers include not less than 10 wt % of a bio-affinity material.

3. A fiber sheet formed of deposited fibers, comprising:

fibers being in a closely-adhered state by a capillary force when a volatile liquid provided among the fibers is dried;

all of following (1) to (3) being satisfied, wherein F1 is a tensile strength in a first direction of the fiber sheet, and F2 is a tensile strength in a second direction orthogonal to the first direction:

(1) F2>F1;

(2) F1 is 1 MPa or more; and (3) F2/F1 is 2 or more.

4. The fiber sheet according to claim 3, wherein a portion of the fiber sheet is in a fused state.

* * * * *